US006814595B2

(12) United States Patent
Miyamoto et al.

(10) Patent No.: US 6,814,595 B2
(45) Date of Patent: Nov. 9, 2004

(54) STRUCTURE FOR PREVENTING FAILURE OF CONNECTOR

(75) Inventors: Masahiro Miyamoto, Haibara-gun (JP); Shigeo Mori, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 9 days.

(21) Appl. No.: 10/052,395

(22) Filed: Jan. 23, 2002

(65) Prior Publication Data

US 2002/0137376 A1 Sep. 26, 2002

(30) Foreign Application Priority Data

Jan. 23, 2001 (JP) ..... P2001-014796

(51) Int. Cl.[7] ..... H01R 13/44
(52) U.S. Cl. ..... 439/148
(58) Field of Search ..... 439/138, 139–147, 439/373, 135–137, 341

(56) References Cited

U.S. PATENT DOCUMENTS

| | | | | |
|---|---|---|---|---|
| 5,478,249 A | * | 12/1995 | Crestin | 439/138 |
| 5,716,224 A | | 2/1998 | Masuda et al. | |
| 6,309,239 B1 | * | 10/2001 | Johnston | 439/373 |
| 6,382,990 B1 | * | 5/2002 | Marechal et al. | 439/138 |

FOREIGN PATENT DOCUMENTS

| | | |
|---|---|---|
| DE | 695 01 873 T2 | 7/1998 |
| EP | 0 473 469 A1 | 3/1992 |
| JP | 6-333642 | 2/1994 |
| JP | 6-333643 | 2/1994 |
| JP | 6-203919 | 7/1994 |
| JP | 8-138785 | 5/1996 |

OTHER PUBLICATIONS

Japanese abstract 06–333642, Feb. 12, 1994.
Japanese abstract 06–333643, Feb. 12, 1994.
Japanese abstract 08–138785, May 31, 1996.
Japanese abstract 06–203919, Jul. 22, 1994.

* cited by examiner

*Primary Examiner*—J. F. Duverne
(74) *Attorney, Agent, or Firm*—Sughrue Mion, PLLC

(57) ABSTRACT

A receiving-side subconnector having a structure for preventing failure of a connector of the invention has a cap, which is pushed in an opening direction, and a cap lock provided at a side opposite thereto. At a rear end of this cap lock, a relief groove, which serves as a disengaging mechanism and is provided at a rear end part extending along the longitudinal direction of a ring-like support portion engaged with a cap lock shaft. This relief groove is set so that when an external force, whose magnitude is equal to or larger than a set value, acts thereon, the cap lock shaft gets out of the relief groove.

13 Claims, 8 Drawing Sheets

STRUCTURE FOR PREVENTING FAILURE OF CONNECTOR

BACKGROUND OF THE INVENTION

1. Field of the Invention

The present invention relates to a structure for preventing failure of a connector, which is constituted by a pair of female and male subconnectors and aims at electrical connection of an electrically driven apparatus, such as an electric car, which needs to perform charging operations.

2. Related Art

Hitherto, an internal battery (that is, a chargeable battery) mounted in an electric car is charged by a feeder apparatus installed in a feeder station. That is, a feeder subconnector is connected to an end of a feeder cord drawn out of the feeder apparatus. Power is fed to the internal battery, which is electrically connected to a car-side receiving subconnector, by connecting this feeder subconnector to a vehicle-side receiving subconnector.

In a conventional receiving subconnector 50 illustrated in FIGS. 7 and 8, a cap 52 is supported by a cap pin 55 so that neither water nor dust directly enters a housing 51 into which a connecting terminal (not shown) is built.

Further, a cap lock 53 for holding the cap 52 in such a way as to be in a closed state is supported at a side opposite to the cap 52 by a lock pin 56. This cap 52 is always pushed by a cap spring (not shown) in an opening direction. The cap lock 53 is always pushed by a lock spring 54 toward the inside of the housing.

Moreover, in the conventional feeder subconnector 60 illustrated in FIGS. 8 and 9, a housing 61, into which a connection terminal (not shown) is incorporated, and a lock arm 63, which is supported on the arm shaft 64 and used for fitting the receiving subconnector 50 into the housing and for holding the receiving subconnector 50 are built into an outer case 62. Furthermore, an end portion 63*a* of the lock arm 63 is always pushed by a lock arm spring 65.

When the feeder subconnector 60 is inserted into the receiving subconnector 50, the cap lock 53 is unlocked. Then, the cap 52 is opened. Subsequently, the feeder subconnector 60 is inserted thereinto. Thus, the end portion 63*a* of the lock arm 63 is stranded on a tapered surface 51*a* of the housing 51.

Then, the end portion 63*a* of the lock arm 63 passes through the feeder subconnector 60 and is accommodated in a lock arm engaging groove 51*b* by further inserting the feeder subconnector 60 thereinto. Thus, operations of fitting the feeder subconnector 60 into the receiving subconnector 50 and connecting both the subconnectors 50 and 60 to each other are completed.

Further, when both the subconnectors 50 and 60 are disengaged from each other, by pushing an operating portion 63*b* of the lock arm 63. Thus, the lock arm 63 is turned around the arm shaft 64, so that the end portion 63*a* upwardly moves. The subconnectors 50 and 60 can be disengaged from each other by then rearwardly pulling out the feeder subconnector 60.

However, in the case that a force, whose magnitude is equal to or higher than that of a force of an end portion 63*a* of the lock arm 63, acts in a direction, in which both the conventional receiving subconnector 50 and the conventional feeder subconnector 60 are disengaged from each other, in the aforementioned state in which the conventional receiving subconnector 50 and the conventional feeder subconnector 60 are fitted into each other, there has been caused a problem that the lock arm 63 at the side of the feeder subconnector 60 and a lock plate 57 at the side of the receiving subconnector 50 are damaged. Moreover, there has been caused another problem that in some case, a user's fingers touch an exposed connection terminal and thus a user gets an electric shock.

SUMMARY OF THE INVENTION

The invention is accomplished to solve the aforementioned problems of the conventional connector. Accordingly, an object of the invention is to provide a structure for preventing failure of a connector constituted by a pair of male and female subconnectors, which can be disengaged from each other without damaging a connector body in the case that a force damaging both the female and male subconnectors acts in a direction, in which these subconnectors are disengaged from each other, when both the female and male subconnectors are completely fitted into each other.

The aforementioned problems to be solved by the invention can be solved by a structure (hereunder referred to as a first structure of the invention) for preventing failure of a connector constituted by a first subconnector and a second subconnector to be fitted into each other and electrically connected to each other. The first subconnector having an openable and closable cap, which is provided at a front end portion of the first subconnector, for closing the front end portion. Further, a cap lock for preventing, when both the first and second subconnectors are not fitted into each other, the cap from turning being provided on a connector housing. In this structure, the first subconnector or the second subconnector has a disengaging mechanism for disengaging the second subconnector from the first subconnector before damaged, in a case that a force damaging a connector body of one of the first and second subconnectors acts in a disengaging direction after completion of fitting the first and second subconnectors into each other.

Further, the problems can be solved by an embodiment of the first structure of the invention, which is preferably adapted so that the disengaging mechanism is a relief groove provided in the cap lock serving as a fitting lock for locking a state, in which said first and second subconnectors are fitted into each other, after completion of fitting therebetween and that this relief groove is formed in a support portion of the cap lock engaged with a cap lock shaft turnably supporting the cap lock.

In the first structure for preventing failure of the connector, which has the aforementioned configuration, the cap lock functions as a fitting lock for locking the fitting state, in which the first and second subconnectors are fitted into each other, after completion of fitting the first and second subconnectors into each other. Moreover, the first subconnector or the second subconnector has a disengaging mechanism for disengaging the second subconnector from the first subconnector before damaged, in the case that a force damaging a connector body of one of the first and second subconnectors acts in a disengaging direction after completion of fitting the first and second subconnectors into each other.

Therefore, even in the case that a force, whose magnitude is sufficient for damaging the connector body of at least one of the subconnectors, acts thereon in a disengaging direction when the first and second subconnectors are completely fitted into each other, the cap lock is disengaged from the first subconnector before the first subconnector or the second subconnector is damaged. Thus, the first subconnector or the second subconnector is disengaged from the other subconnector without being damaged. Consequently, the connecting terminal is not exposed by the failure of the connector body. This reliably prevents an operator from touching the connecting terminal with fingers to thereby get an electric shock. Thus, a high safe connector can be obtained.

Further, the disengaging mechanism is a relief groove that is provided in the cap lock serving as a fitting lock for locking a state, in which the first and second subconnectors are fitted into each other, after completion of fitting the first and second subconnectors into each other and that is formed in a support portion of the cap lock engaged with a cap lock shaft turnably supporting the cap lock.

Therefore, one member is used as both the cap lock and the fitting lock. Thus, the number of components is reduced. Moreover, the cap lock shaft gets out of the relief groove formed in the support portion of the cap lock. Consequently, the second subconnector can easily be disengaged from the first subconnector. Hence, the provision of the disengaging mechanism does not result in increase in the size of the first subconnector or the second subconnector. Both the subconnectors can be reliably disengaged from each other by employing a simple structure. Thus, a low-cost highly-reliable connector can be obtained.

The aforementioned problems can be also solved by a subconnector adapted to be fitted to a mate subconnector comprising an openable and closable cap provided at a front end portion of the subconnector for closing the front end portion; a cap lock provided on a connector housing of the subconnector for preventing a turning of the cap when the subconnector is not fitted into the mate subconnector, the cap lock serving as a fitting lock for locking the mate subconnector when the subconnector is fitted to the mate subconnector; a cap lock shaft engaged with a support portion of the cap lock so as to turnably support the cap lock; and a relief groove provided in the support portion of the cap lock, and wherein the relief groove disengages the cap lock shaft from the support portion in a case that a predetermined force acts in a disengaging direction of the subconnector and the mate

DETAILED DESCRIPTION OF THE PREFERRED EMBODIMENT

Figure 1:
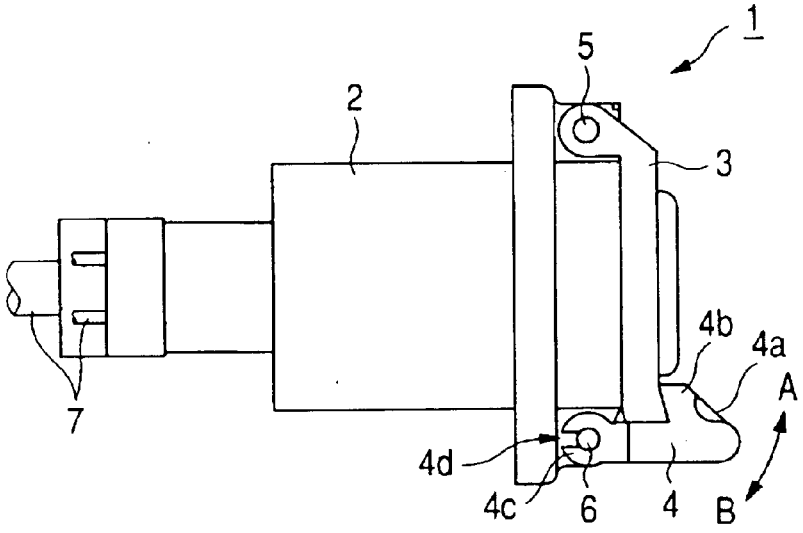
FIG. 1 is a plan view illustrating an embodiment of a receiving-side subconnector of a connector according to the invention.
Figure 2:
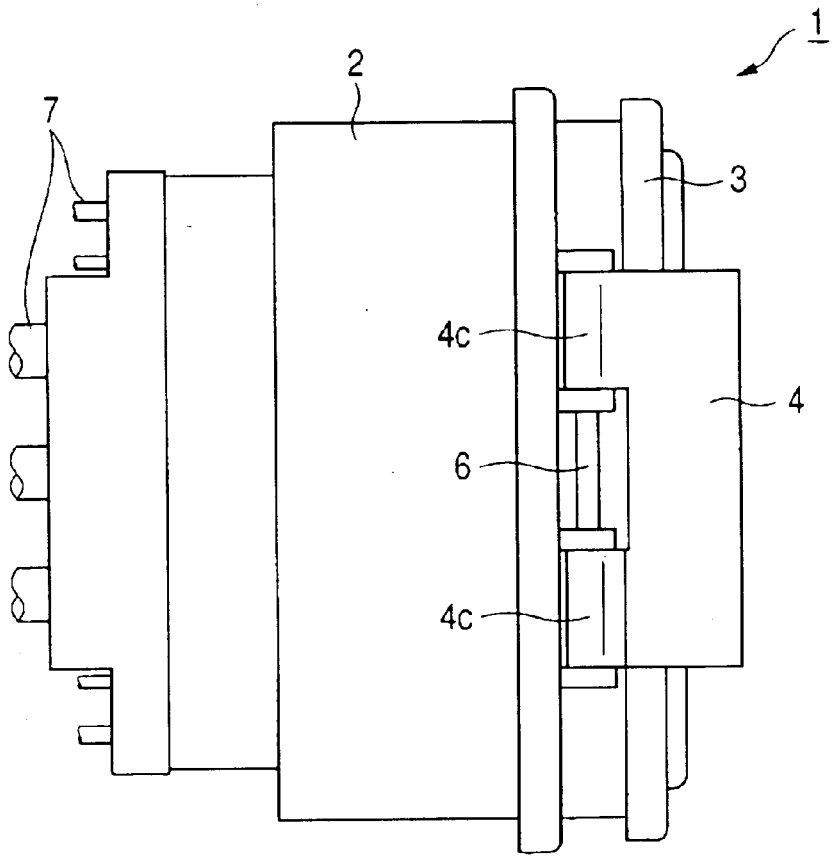
FIG. 2 is a side view illustrating the receiving-side subconnector of FIG. 1.
Figure 3:
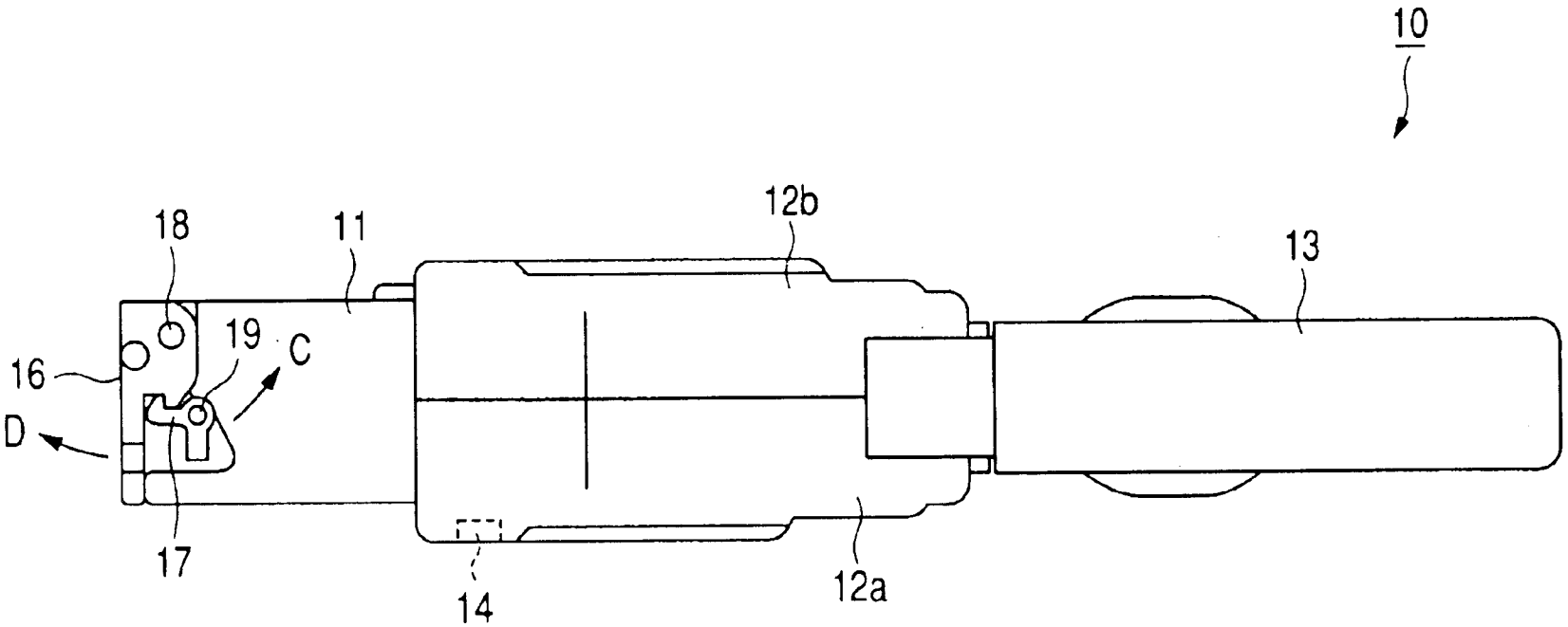
FIG. 3 is a plan view illustrating an embodiment of a feeding-side subconnector of a connector according to the invention.
Figure 4:
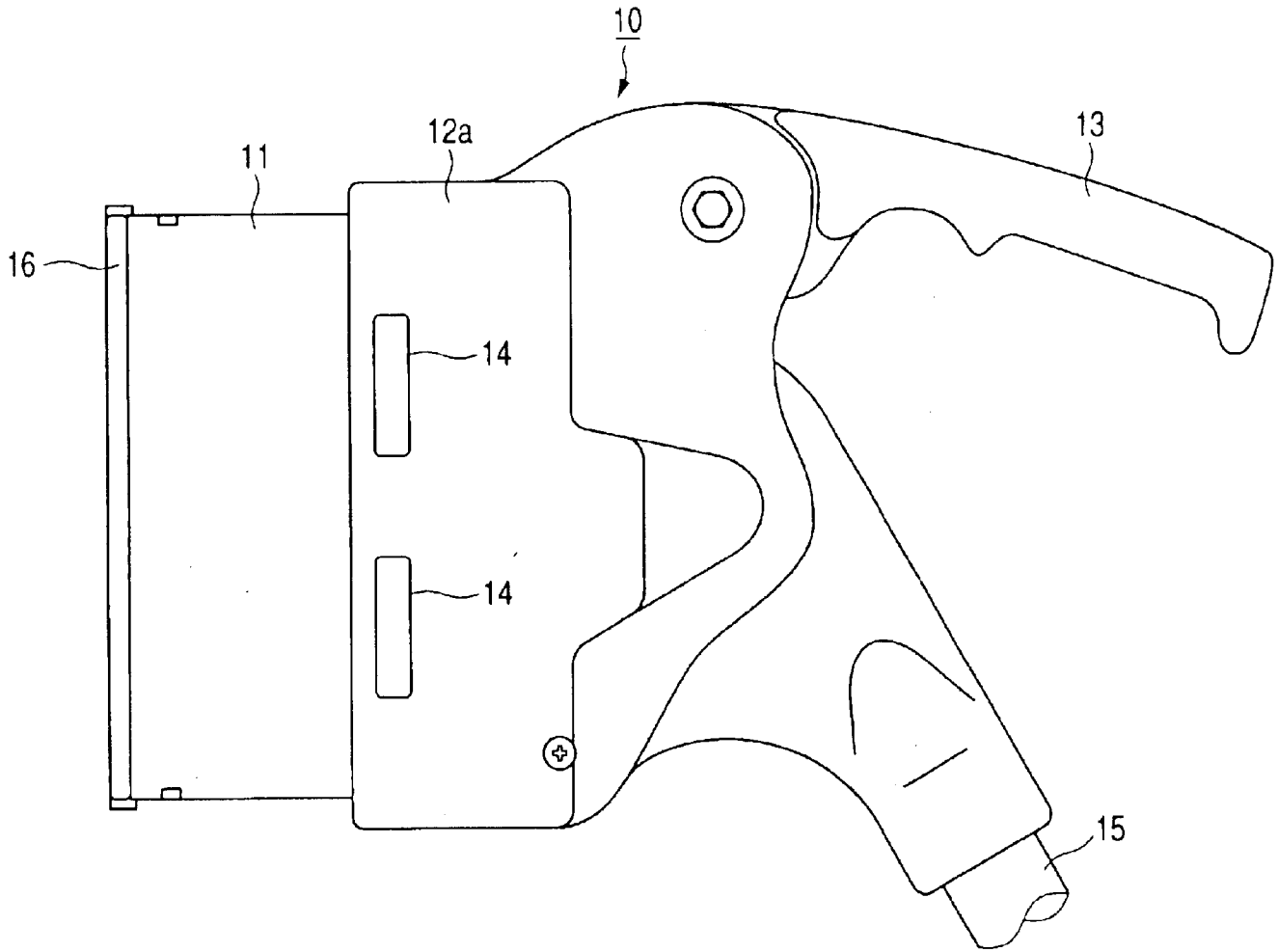
FIG. 4 is a side view illustrating the feeding-side subconnector of FIG. 3.
Figure 5:
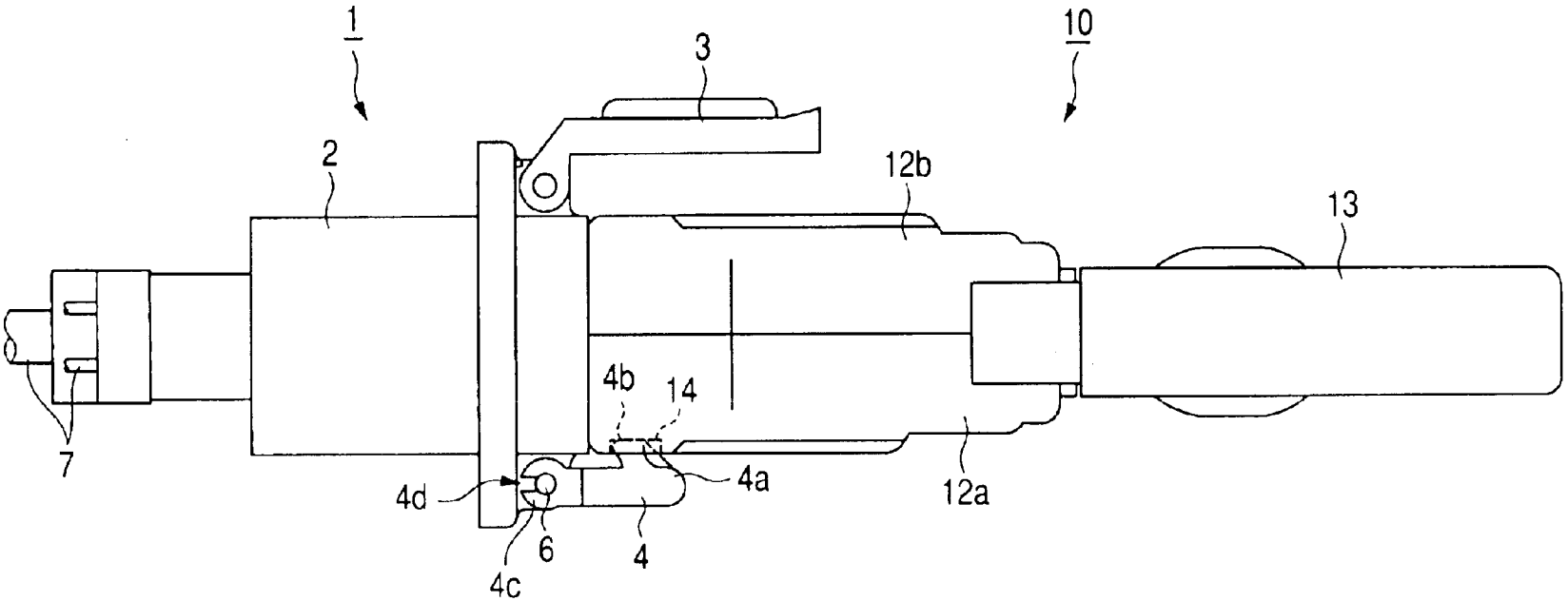
FIG. 5 is a plan view illustrating a state in which the fitting between the feeding-side and receiving-side subconnectors of the connector is completed.
Figure 6:
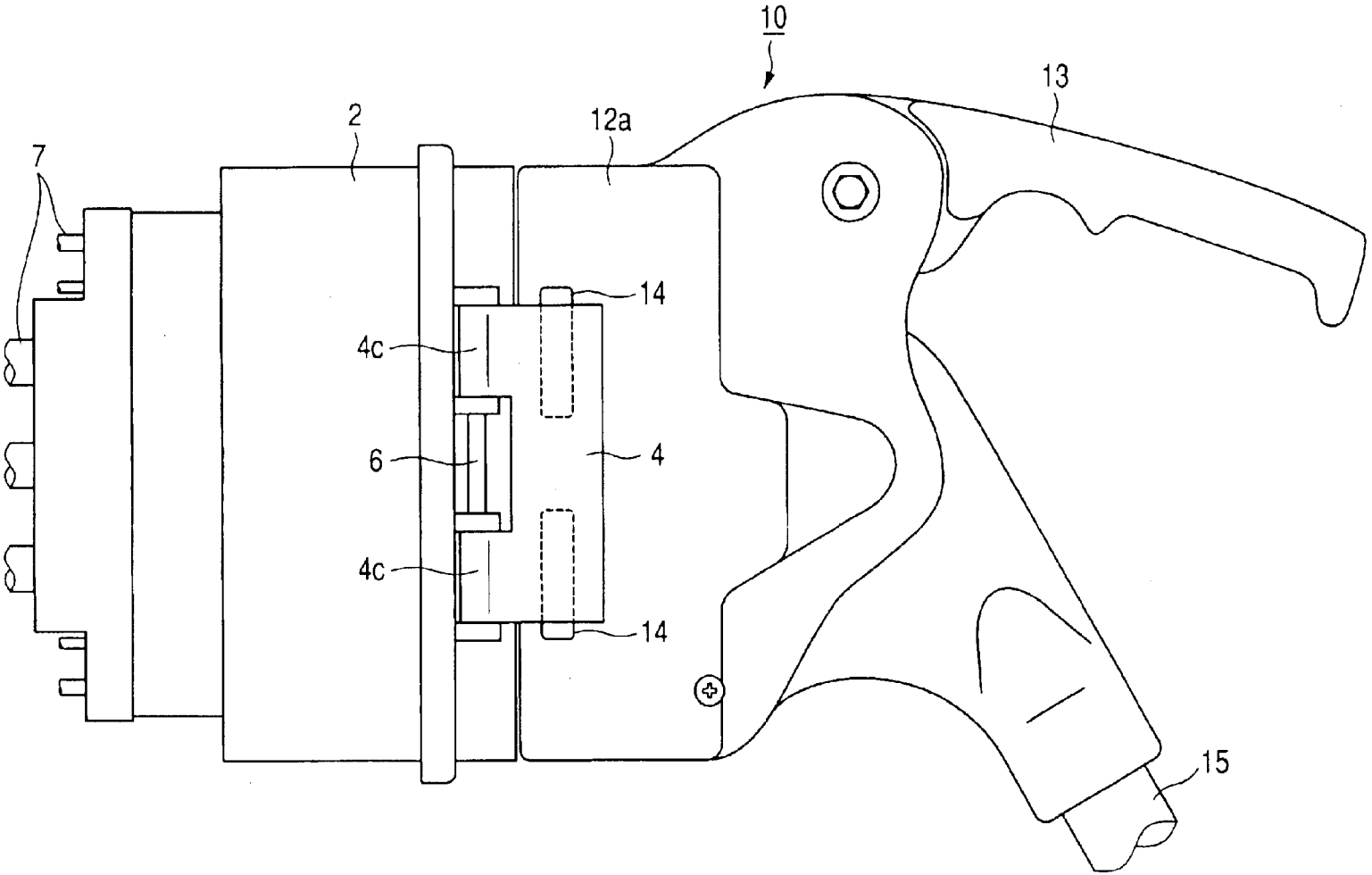
FIG. 6 is a side view illustrating the connector shown in FIG. 5.
Figure 7:
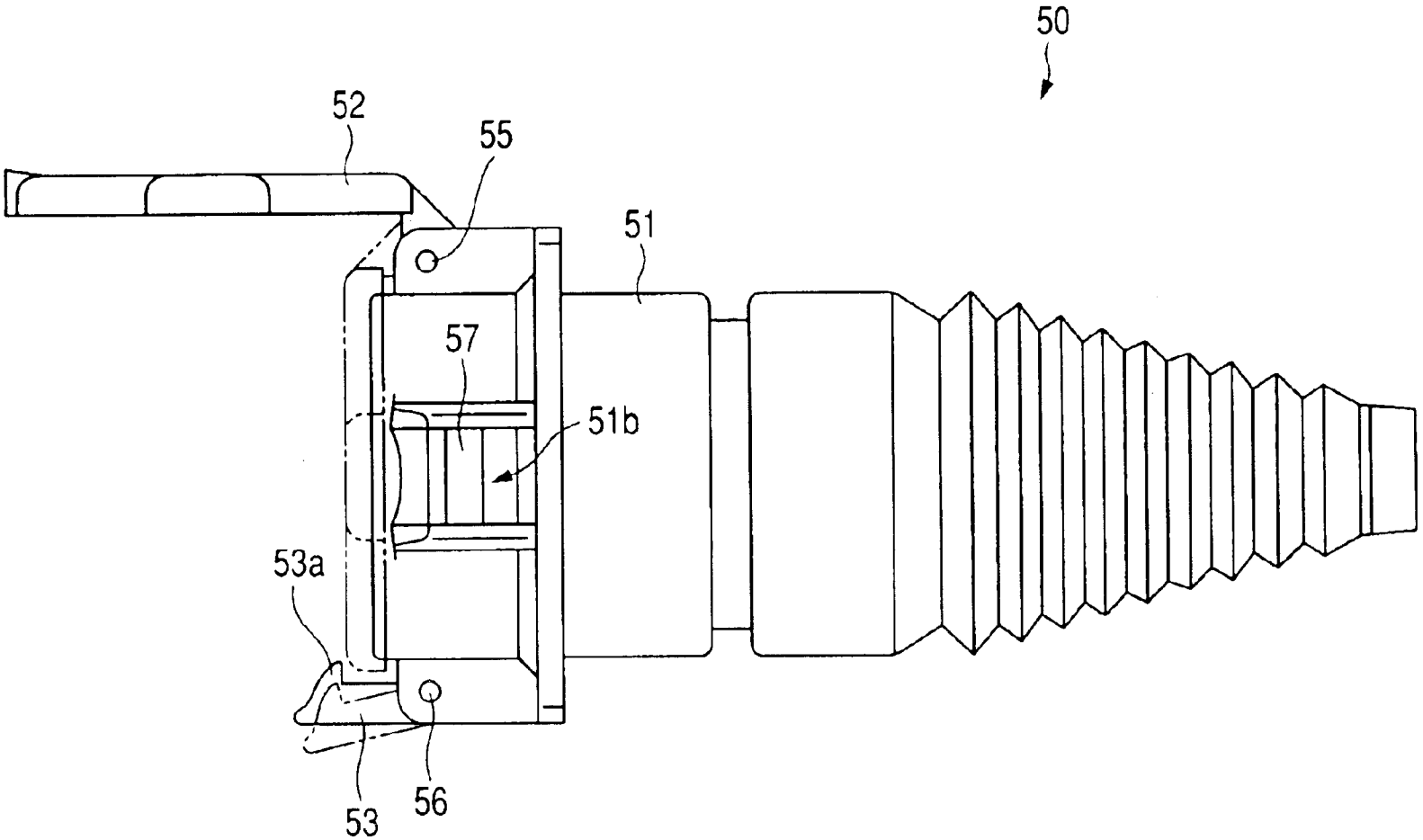
FIG. 7 is a side view illustrating an example of a conventional receiving-side subconnector.
Figure 8:
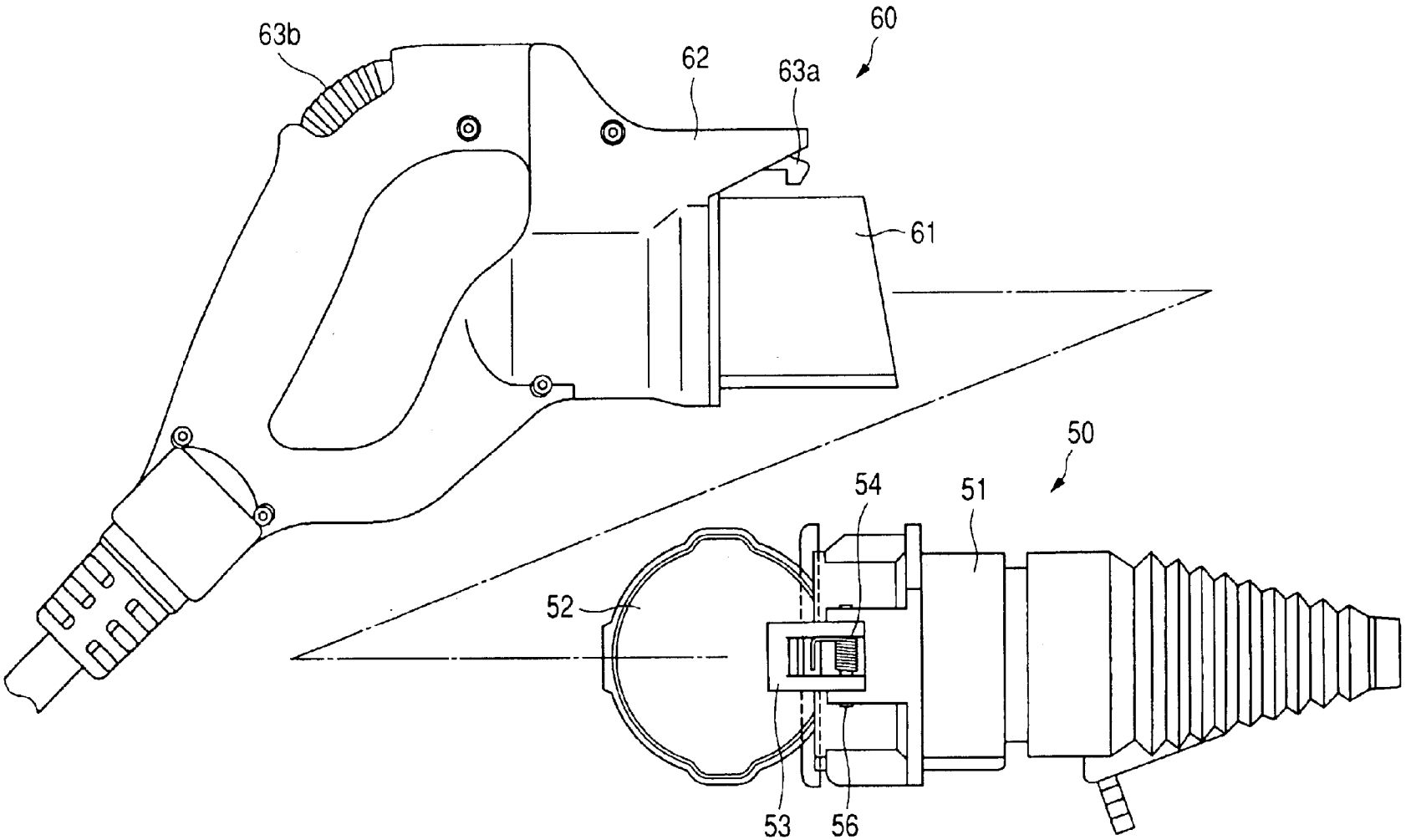
FIG. 8 is a side view illustrating an example of a feeding side connector to be fitted to the receiving-side subconnector of FIG. 7.
Figure 9:
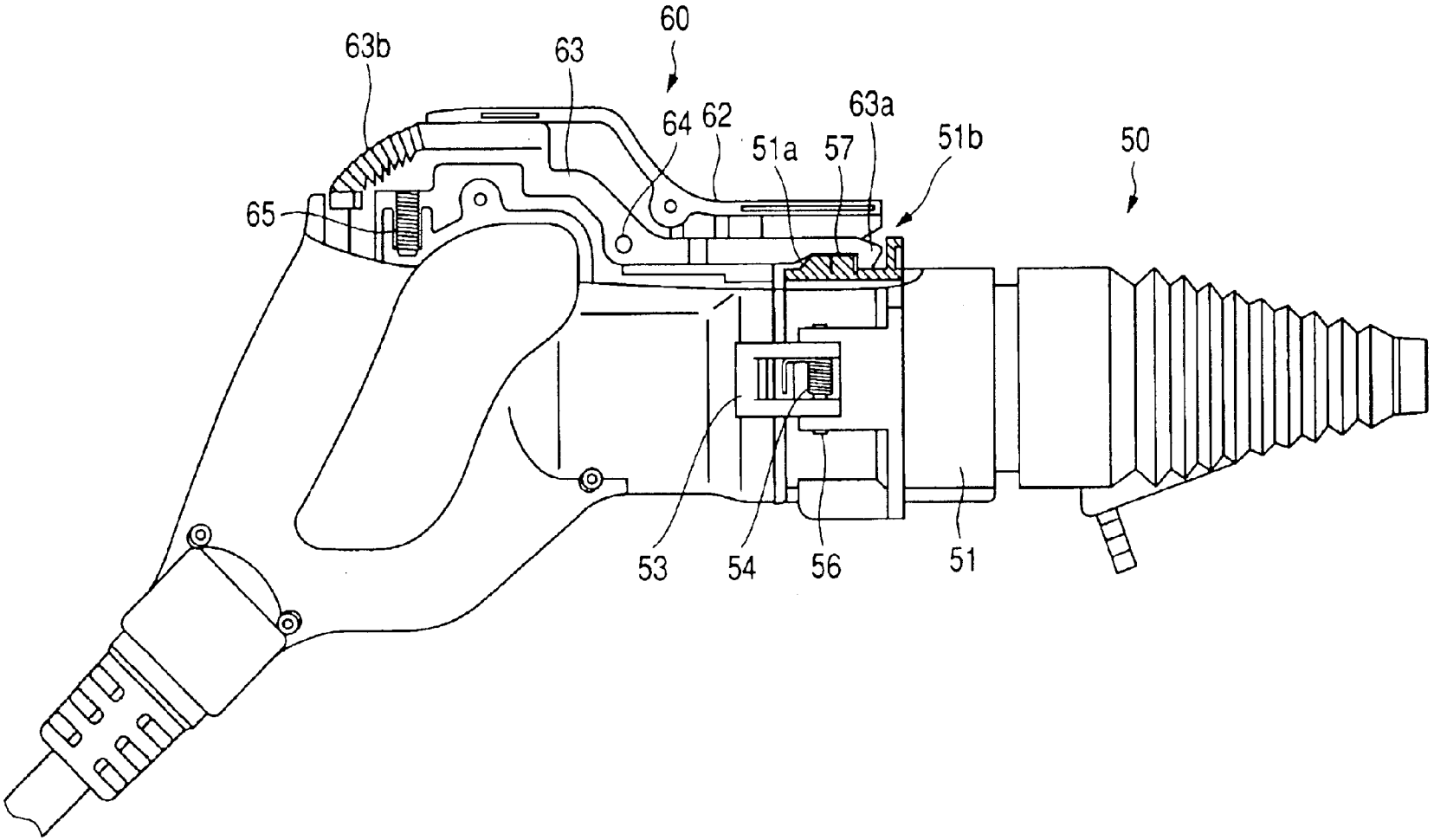
FIG. 9 is a side view illustrating a state in which the receiving-side subconnector and the feeding-side subconnector shown in FIG. 8 are fitted into each other.

Hereinafter, an embodiment of a structure for preventing failure of a connector according to the invention is described in detail with reference to FIGS. 1 to 6. FIG. 1 is a plan view illustrating an embodiment of a receiving-side subconnector of the connector according to the invention. FIG. 2 is a side view illustrating the receiving-side subconnector of FIG. 1. FIG. 3 is a plan view illustrating an embodiment of a feeding-side subconnector of the connector according to the invention. FIG. 4 is a side view illustrating the feeding-side subconnector of FIG. 3. FIG. 5 is a plan view illustrating a state in which the fitting between the receiving-side subconnector and the feeding-side subconnector of the connector is completed. FIG. 6 is a side view illustrating the connector shown in FIG. 5. Incidentally, in the description of this embodiment, the description of the internal structure, such as a connecting terminal, of each of the receiving-side subconnector and the feeding-side subconnector is omitted.

As illustrated in FIGS. 1 and 2, a receiving-side subconnector 1 serving as the first subconnector of the connector according to this embodiment has a waterproof and dustproof cap 3, which is supported on a cap shaft 5 at a front end portion of a housing 2 accommodating a connecting terminal (not shown) press-attached to an end portion of a wire 7 and which is pushed by a cap spring (not shown) in an opening direction.

A cap lock 4 supported on the cap lock shaft 6 and pushed by a cap lock spring (not shown) in the direction of the central axis of the housing 2 is provided on a side opposite to the cap 3 disposed on the front end portion of the housing 2. This cap lock 4 has a tapered surface 4*a* at a front end thereof and also has a hook-like end portion 4*b*.

A relief groove 4*d*, which serves as a disengaging mechanism and is provided at a rear end part extending along the longitudinal direction of a ring-like support portion 4 engaged with a cap lock shaft 6. The dimension of width of this relief groove 4*d* is slightly smaller than an outside diameter of the cap lock shaft 6 and set so that when an external force, whose magnitude is equal to or larger than a set value, acts thereon in a direction, in which the subconnectors 1 and 10 are disengaged from each other, during these subconnectors are in a completely fitted state, the cap lock shaft 6 gets out of the relief groove 4*d*.

A receiving-side shutter (not shown) serving as a first waterproof and dustproof shutter turnably supported on a shaft and pushed by a spring in an opening direction is provided in a front portion of the housing 2. Thus, the receiving-side subconnector 1 has a double closing structure that has the cap 3 provided at the front end portion and also has the receiving-side shutter.

As illustrated in FIGS. 3 and 4, in the feeding-side subconnector 10 serving as a second subconnector, the housing 11, which accommodates a connecting terminal press-attached to an end portion of the wire 15, and the operation lever 13 to be operated at the fitting of the feeding-side subconnector 10 to the receiving-side subconnector 1 and at the disengagement of the former subconnector from the latter subconnector are sandwiched by outer cases 12*a* and 12*b* from both sides thereof and fastened with bolts and nuts.

Two lock accommodating portions 14 each for engaging an end portion 4*b* of the cap lock 4 are provided in a side surface portion of one 12*a* of the outer cases. Moreover, a waterproof and dustproof feeding-side shutter 16 supported on the shutter shaft 18 and pushed by a shutter spring in an opening direction is provided at the front end portion of the housing 11.

Further, the shutter lock 17 supported on the shutter lock shaft 19 and pushed by a spring in the direction of the shutter shaft 18 is provided adjacent to the feeding-side shutter 16.

Next, fitting and disengaging operations of a structure for preventing failure of the connector according to this embodiment is described hereinbelow.

First, when the cap lock 4 of the receiving-side subconnector 1 is displaced in the direction of an arrow B by a finger, as illustrated in FIG. 1, the lock state of the cap 3 is released. Thus, the cap 3 is opened in the direction of an arrow A. That is, the cap 3 is automatically turned around the cap shaft 5 by the action of a cap spring (not shown) by releasing the cap lock 4. Thus, the front end portion of the housing 2 is put into an open state. Then, the cap lock 4 is returned by the action of a cap lock spring (not shown) by taking the finger off the cap lock 4.

Subsequently, the lock state of the receiving-side shutter is released by inserting an end portion of the feeding-side subconnector 10 into the housing 2 of the receiving-side subconnector 1. The receiving-side shutter is pushed by the end portion of the feeding-side subconnector 10 and then released.

When the feeding-side subconnector 10 is further inserted thereinto, as illustrated in FIG. 3, the shutter lock 17 at the side of the feeding-side subconnector 10 turns in the direction of an arrow C. Thus, the lock state of the feeding-state shutter 16 is released. Then, as the feeding-side subconnector 10 is inserted thereinto, the feeding-side shutter 16 turns around the shutter shaft 18 in an opening direction D.

When the feeding-side subconnector 10 is further inserted into the receiving-side subconnector 1, as illustrated in FIG. 5, the front surface portion of one 12*a* of the outer cases abuts against the tapered surface 4*a* of the cap lock 4. Then, the cap lock 4 turns in the direction of the arrow B (see FIG. 1) along the tapered surface 4*a*. Finally, the end portion 4*b* of the cap lock 4 is fitted into the lock accommodating portion 14 of the outer case 12*a*. Thus, the fitting between the subconnectors 1 and 10 is completed.

Next, when the feeding-side subconnector 10 is disengaged from the receiving-side subconnector 1, the subconnector 10 can easily be disengaged therefrom by releasing the cap lock 4 with a finger and then drawing out the feeding-side subconnector 10 therefrom in a state in which the cap lock 4 is released. At that time, each of the opened feeding-side shutter 16 and the opened receiving-side shutter (not shown) is automatically turned in a closing direction by a pushing force of the corresponding spring.

In the case that each of the subconnectors undergoes a disengaging force, whose strength is larger than that of the connector body thereof, in a time period from a time, at which the receiving-side and feeding-side subconnectors are completely fitted into each other, to another time, at which both these subconnectors are disengaged therefrom after completion of charging, the cap lock shaft 6 gets out of the relief groove 4*d* by maintaining the state in which the end portion 4*b* of the cap lock 4 is fitted into the lock accommodating portion 14.

Consequently, the receiving-side subconnector 1 and the feeding-side subconnector 10 are disengaged from each other without being damaged. Thus, the connecting terminals are not exposed by damaging the connector bodies. This can reliably prevent an operator from touching the connecting terminal with a finger to thereby get an electric shock.

The present invention is not limited to the above embodiment, but suitable modifications and improvements can be made.

For example, the cap lock 4 and the relief groove 4*d* are provided on the receiving-side subconnector 1 although in the above embodiment, they may be provided on the feeding-side subconnector.

As described above, in the structure of the invention for preventing failure of the connector, which has the aforementioned configuration, the cap lock functions as a fitting lock for locking the fitting state, in which the first and second subconnectors are fitted into each other, after completion of fitting the first and second subconnectors into each other. Moreover, the first subconnector or the second subconnector has a disengaging mechanism for disengaging the second subconnector from the first subconnector before damaged, in the case that a force damaging a connector body of one of the first and second subconnectors acts in a disengaging direction after completion of fitting the first and second subconnectors into each other.

Therefore, even in the case that a force, whose magnitude is sufficient for damaging the connector body of at least one of the subconnectors, acts thereon in a disengaging direction when the first and second subconnectors are completely fitted into each other, the cap lock is disengaged from the first subconnector before the first subconnector or the second subconnector is damaged. Thus, the first subconnector or the second subconnector is disengaged from the other subconnector without being damaged. Consequently, the connecting terminal is not exposed by failure of the connector body. This reliably prevents an operator from touching the connecting terminal with fingers to thereby get an electric shock. Thus, a high safe connector can be obtained.

Further, the disengaging mechanism is a relief groove that is provided in the cap lock serving as a fitting lock for locking a state, in which the first and second subconnectors are fitted into each other, after completion of fitting therebetween and that is formed in a support portion of the cap lock engaged with a cap lock shaft turnably supporting the cap lock.

Therefore, one member is used as both the cap lock and the fitting lock. Thus, the number of components is reduced. Moreover, the cap lock shaft gets out of the relief groove formed in the support portion of the cap lock. Consequently, the second subconnector can easily be disengaged from the first subconnector. Hence, the provision of the disengaging mechanism does not result in increase in size of the first subconnector or the second subconnector. Both the subconnectors can be reliably disengaged from each other by employing a simple structure. Thus, a low-cost highly-reliable connector can be obtained.

What is claimed is:

1. A structure for preventing failure of a connector including a first subconnector and a second subconnector comprising:

an openable and closable cap provided at a front end portion of said first subconnector for closing said front end portion;

a cap lock provided on a connector housing of said first subconnector for preventing a turning of said cap when said first subconnector is not fitted into said second subconnector; and a disengaging mechanism provided in at least one of said first and second subconnectors for disengaging said second subconnector from said first subconnector in a case that a predetermined force acts in a disengaging direction after completion of fitting said first subconnector into said second subconnector, whereby the failure of said connector is prevented.

2. The structure for preventing failure of the connector according to claim 1, wherein said disengaging mechanism includes a relief groove provided in said cap lock serving as a fitting lock for locking said second subconnector when said first subconnector and said second subconnector are fitted into each other after completion of fitting therebetween and said relief groove is formed in a support portion of said cap lock engaged with a cap lock shaft turnably supporting said cap lock.

3. A subconnector adapted to be fitted to a male subconnector comprising:

an openable and closable cap provided at a front end portion of said subconnector for closing said front end portion;

a cap lock provided on a connector housing of said subconnector for preventing a turning of said cap when said subconnector is not fitted into said mate subconnector, said cap lock serving as a fitting lock for locking said mate subconnector when said subconnector is fitted to said mate subconnector;

a cap lock shaft engaged with a support portion of said cap lock so as to turnably support said cap lock; and a relief groove provided in said support portion of said cap lock, and wherein said relief groove disengages said cap lock shaft from said support portion in a case that a predetermined force acts in a disengaging direction of said subconnector and said mate subconnector.

4. A structure for preventing failure of a connector including a first subconnector and a second subconnector comprising:

an openable and closable cap provided at a front end portion of said first subconnector for closing said front end portion;

a cap lock provided on a connector housing of said first subconnector for preventing a turning of said cap when said first subconnector is not fitted into said second subconnector; and a disengaging mechanism provided in at least one of said first and second subconnectors for disengaging said second subconnector from said first subconnector in a case that a predetermined force acts in a disengaging direction after completion of fitting said first subconnector into said second subconnector, whereby the failure of said connector is prevented, wherein:

said disengaging mechanism includes a relief groove provided in said cap lock serving as a fitting lock for locking said second subconnector when said first subconnector and said second subconnector are fitted into each other after completion of fitting therebetween; and said relief groove is formed in a support portion of said cap lock engaged with a cap lock shaft turnably supporting said cap lock.

5. The structure for preventing failure of the connector according to claim 2, wherein a lock accommodating portion for engaging an end portion of the cap lock is provided in a side surface portion of the second subconnector.

6. A subconnector adapted to be fitted to a mate subconnector according to claim 3, wherein a lock accommodating portion for engaging an end portion of the cap lock is provided in a side surface portion of the mate subconnector.

7. The structure for preventing failure of the connector according to claim 4, wherein a lock accommodating portion for engaging an end portion of the cap lock is provided in a side surface portion of the second subconnector.

8. The structure for preventing failure of the connector according to claim 2, wherein the cap lock has a generally hook-shaped cross section.

9. A subconnector adapted to be fitted to a mate subconnector according to claim 3, wherein the cap lock has a generally hook-shaped cross section.

10. The structure for preventing failure of the connector according to claim 4, wherein the cap lock has a generally hook-shaped cross section.

11. The structure for preventing failure of the connector according to claim 2, wherein the cap lock has a width that extends across a substantial portion of the first subconnector.

12. A subconnector adapted to be fitted to a mate subconnector according to claim 3, wherein the cap lock bus a width that extends across a substantial portion of the subconnector.

13. The structure for preventing failure of the connector according to claim 4, wherein the cap lock has a width that extends across a substantial portion of the flat subconnector.

* * * * *